US006023138A

United States Patent [19]

Fried et al.

[11] Patent Number: 6,023,138

[45] Date of Patent: Feb. 8, 2000

[54] FAN VENTURI BLOCKAGE DETECTION

[75] Inventors: Dennis Wayne Fried, Tucson, Ariz.; Sung Jin Kim, Taejon, Rep. of Korea

[73] Assignee: International Business Machines Corporation, Armonk, N.Y.

[21] Appl. No.: 08/927,730

[22] Filed: Sep. 11, 1997

[51] Int. Cl.[7] ..... H02K 17/32

[52] U.S. Cl. ..... 318/434; 361/93; 361/23; 361/31

[58] Field of Search ..... 318/434; 323/277, 323/287; 361/93–97, 23, 31

[56] References Cited

U.S. PATENT DOCUMENTS

| | | | |
|---|---|---|---|
| 3,990,069 | 11/1976 | Schuman | 340/240 |
| 4,240,072 | 12/1980 | Fowler | 340/664 |
| 4,873,408 | 10/1989 | Smith | 219/10.55 B |
| 4,875,000 | 10/1989 | Fry et al. | 318/798 |
| 4,933,614 | 6/1990 | Kawata | 318/432 |
| 4,977,375 | 12/1990 | Toth | 324/511 |
| 5,098,657 | 3/1992 | Blackford et al. | 422/73 |
| 5,166,585 | 11/1992 | Koharagi et al. | 318/254 |
| 5,596,271 | 1/1997 | Lowery | 324/174 |

*Primary Examiner*—Robert E. Nappi
*Assistant Examiner*—Rita Leykin
*Attorney, Agent, or Firm*—John H. Holcombe; Robert M. Sullivan

[57] ABSTRACT

A fan venturi blockage detector for a DC electric fan and an associated method are disclosed employing a current detector for measuring the input current to the DC electric fan, and a processor connected to the current detector. The processor stores the measured input current value for the minimum input current to the fan under normal operating conditions, and sets a minimum current threshold at a value less than the normal operating condition measured current. The processor compares subsequent measured input current values with the minimum current threshold value, and provides an error signal upon the subsequent measured input current having a value equal to or less than the minimum current threshold value.

18 Claims, 2 Drawing Sheets

FAN VENTURI BLOCKAGE DETECTION

TECHNICAL FIELD

This invention relates to DC electric fans, and, more particularly, to the detection of venturi blockage in DC electric fans.

BACKGROUND OF THE INVENTION

Fans typically are the low cost, but essential element in electronic systems which generate heat and require cooling. Failure of a fan system will lead to excessive heat generation and possible failure and/or damage to the electronic systems.

Sensors have been employed to detect the failure of the fan motor of DC electric motors by detecting the absence of current pulses in the input drive signal, and tachometers have been employed to detect the rotation of fans. Detection of fan failure alone does not indicate whether the air flow may be blocked by venturi blockage, because the fan blades can still be rotating even when the venturi area is completely blocked. Electro-mechanical sensors have been employed to detect air flow in the system, but are susceptible to mechanical malfunctions. Thermal detectors have been used to detect high ambient temperature of the electronic systems, but do not differentiate the cause of a high temperature. Such detectors provide detection of overheating so that an alarm may be activated so that some action may be taken before any damages including loss of data and/or fire arise. Thermal detectors are an expensive approach and require extensive testing to determine the trip point.

SUMMARY OF THE INVENTION

An object of the present invention is to provide a reliable sensor for detecting venturi blockage of a DC electric fan.

A fan venturi blockage detector for a DC electric fan and an associated method are disclosed employing a current detector for measuring the input current to the DC electric fan, and a processor connected to the current detector. The processor stores the measured input current value for the minimum input current to the fan when the fan is operating under normal operating conditions, and sets a minimum current threshold at a value less than the normal operating condition measured current. The processor compares subsequent measured input current values with the minimum current threshold value, and provides an error signal upon the subsequent measured input current having a value equal to or less than the minimum current threshold value.

The processor sets the minimum current threshold value at a predetermined difference less than the stored normal current value. For example, the threshold may be set at 3% less than the stored normal current value.

The processor may transmit the error signal to the device cooled by the fan to turn off the device, and may also transmit the error signal to the fan to turn off the fan.

For a fuller understanding of the present invention, reference should be made to the following detailed description taken in conjunction with the accompanying drawings.

DETAILED DESCRIPTION OF THE INVENTION

Figure 1:
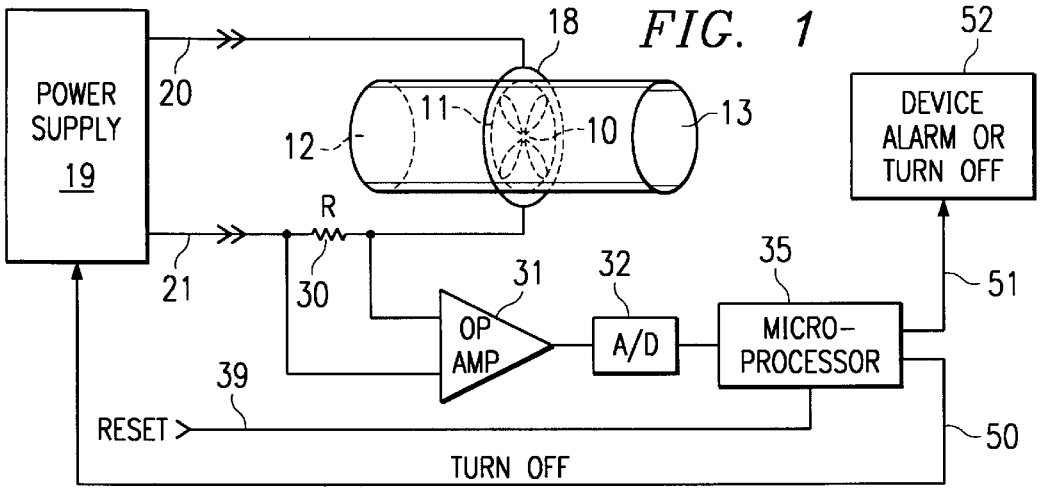
FIG. 1 is a block diagram of an embodiment of a fan venturi blockage detector of the present invention.

Referring to FIG. 1, a fan 10 is illustrated diagrammatically, having a venturi 11 with an inlet 12 and outlet 13. In most electronic systems, the fan 10 is of the impeller type with a DC brushless electric motor 18. The typical fan DC electric motor is operated at a constant speed by a power supply 19. Power supply 19 provides an input current to the fan 10 at a positive voltage on line 20 and line 21 is the return (ground).

Figure 2:
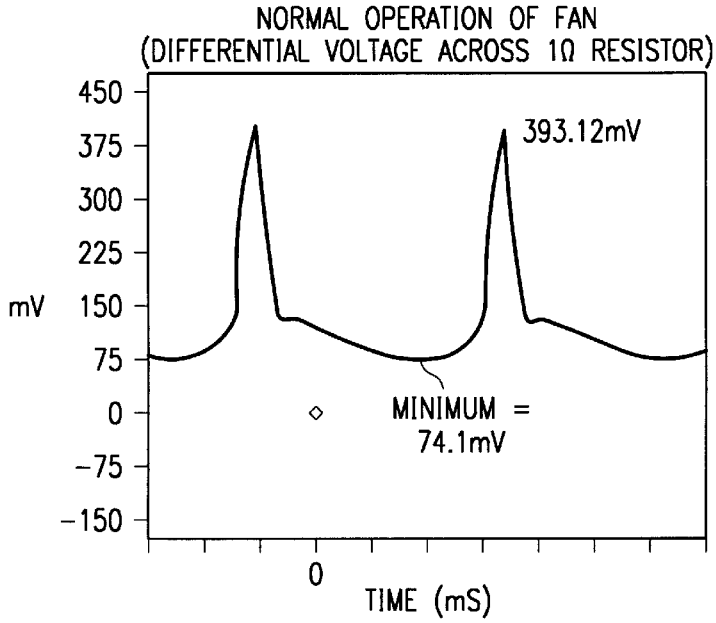
FIG. 2 is a graphical representation of the input current to a DC electric motor under normal operating conditions.

FIG. 2 illustrates the input current (by showing the voltage across resistor 30) from power supply 19 to DC electric motor 18 over lines 20 and 21, when the fan is operating normally.

Laboratory tests by the inventors found that the minimum value of the input current to a fan decreases as the venturi area is blocked. The present invention capitalizes on this finding to detect blockage of the venturi.

In accordance with an embodiment of the present invention, a current detector is provided to detect the DC current in line 21 from power supply 19 to DC electric fan motor 18. The current detector may include a resistor 30, an op amp 31, and an analog to digital converter (ADC) 32. The resistor 30 provides a voltage which is representative of the current in line 21, and op amp 31 amplifies the analog voltage. An analog to digital converter 32 converts the analog output of op amp 31 to a digital signal for a digital processor 35. In the example of FIG. 2, the resistor 30 of FIG. 1 was selected to be 1 ohm. One of skill in the art will understand that the resistance value will be selected to correspond to the impedance characteristics of motor 18.

The digital processor 35 may be implemented in hard wired logic circuitry, may be implemented in special purpose processors, or may be implemented in high speed general purpose programmed processors. Alternatively, op amp 31, ADC 32 and processor 35 may be implemented in a single LSI chip.

Figure 3:
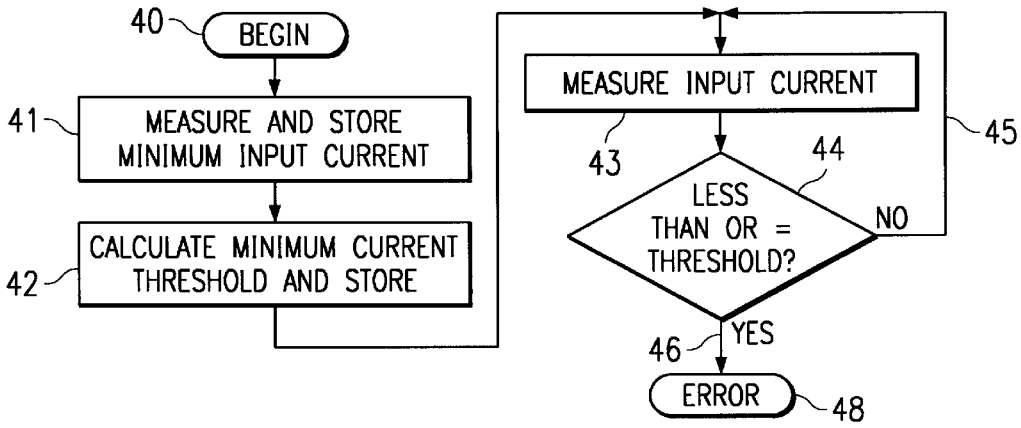
FIG. 3 is a flow chart of an embodiment of the method of the present invention.

FIG. 3 illustrates an embodiment of the method of the present invention as implemented with processor 35.

As discussed above, thermal detectors require extensive testing to determine the proper trip point for the type of device that the fan is employed in, and may require extensive testing in the specific device that the fan is employed in.

The sensing method of the present invention is adaptive and may be initialized when installed in the device, and will provide an accurate alarm for the device without the extensive testing of a thermal detector. The initialization may be made by providing a signal on Reset line 39.

Referring to FIGS. 1 and 3, the method begins at an initialization step 40, preferably upon receipt of a reset signal on line 39, with measuring 41 the current detector signal of FIG. 2 at analog to digital detector 32 during normal operation of the device and fan. As illustrated in FIG. 2, the DC electric motor 18 follows a cyclic pattern each revolution.

Step 41 measures and stores the voltage representative of the minimum input current detected at the current detector, which, in the example illustrated in FIG. 2, is approximately 74.1 mv.

In step 42, the minimum input current from normal operation stored in step 41 is employed as the basis to calculate or otherwise determine a minimum input current threshold. In one example, the minimum current threshold is calculated at a predetermined difference from and less than the stored normal current value, and the calculated threshold value is stored, setting the minimum input current threshold. Specifically, the calculated threshold value may be set at 3% less than the stored normal current value. In the example of the input current of FIG. 2, the voltage representative of the minimum input current was 74.1 mv. Thus, the exemplary threshold value is 71.8 mv.

Once initialized, the method moves to the steady state steps of continually measuring the input current in step 43 and continually comparing 44 the measured input current to the stored minimum current threshold of step 42. So long as the minimum input current is not less than or equal to the threshold (the "NO" branch) 45, the method cycles back to step 43 to again measure the input current.

If the measured minimum input current falls to or below the set threshold value (the "YES" branch) 46, an error is identified in step 48.

Figure 4:
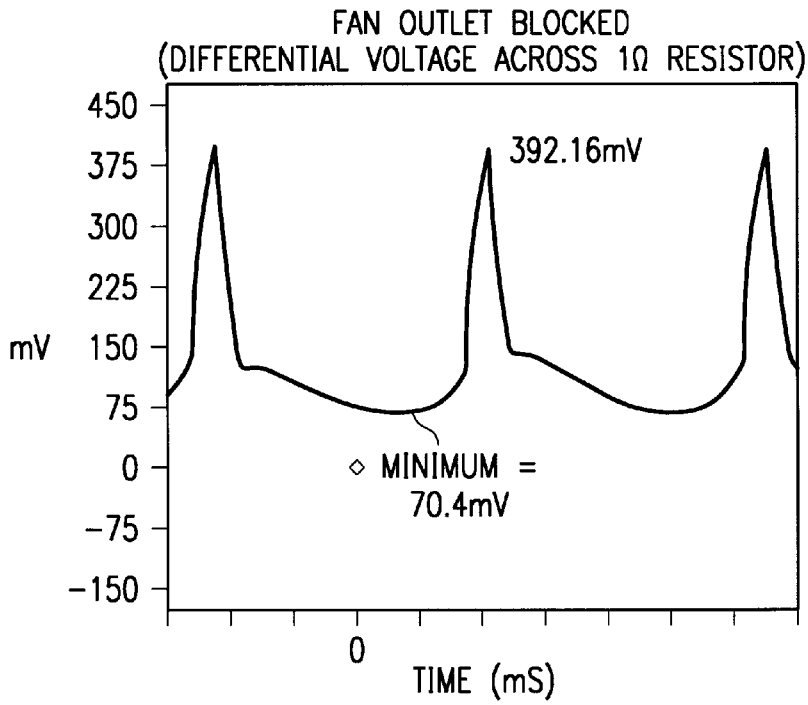
FIG. 4 is a graphical representation of the input current to a DC electric motor with the fan venturi outlet blocked.

FIG. 4 illustrates the input current from power supply 19 to DC electric motor 18 over lines 20 and 21, of the exemplary fan 10 of FIG. 1 when outlet 13 is blocked. As illustrated, the voltage representing the minimum input current drops to 70.4 mv. Thus, the minimum value of 70.4 mv when the outlet 13 is blocked is less than the calculated minimum threshold of 71.8 mv.

Figure 5:
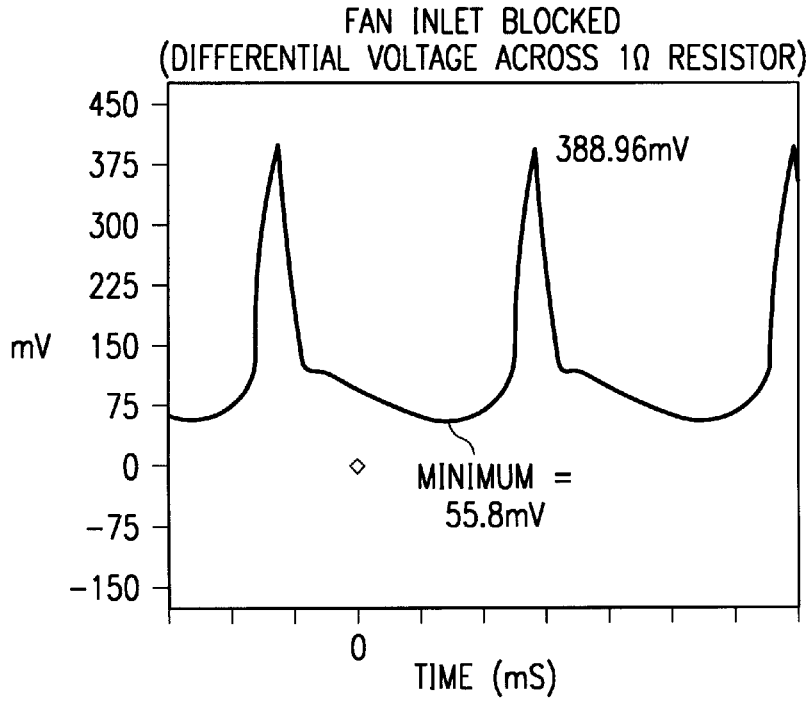
FIG. 5 is a graphical representation of the input current to a DC electric motor with the fan venturi inlet blocked.

FIG. 5 illustrates the input current from power supply 19 to DC electric motor 18 over lines 20 and 21, of the exemplary fan 10 of FIG. 1 when inlet 12 is blocked. As illustrated, the voltage representative of the minimum input current drops to 55.8 mv. Thus, the voltage representative of the minimum current value of 55.8 mv when the inlet 12 is blocked is less than the calculated minimum threshold of 71.8 mv.

The error provided in step 48 may be a signal sent on line 51 to an alarm or turn off 52 for the device that the fan is mounted in. In addition, the error provided in step 48 may be a signal sent on line 50 of FIG. 1 to turn off fan power supply 19.

Additionally, the step 44 of detecting the minimum current equal to or less than the threshold may further calculate the difference between the stored threshold value and the detected value, and then determine from that difference whether the input 12 or the output 13 of the fan is blocked. Using the examples of FIGS. 4 and 5, if the voltage representative of the minimum input current is less than 71.8 mv and greater than 65.0 mv, then the fan outlet 13 is blocked. If the voltage representative of the minimum input current is less than 65.0 mv, then the fan inlet is blocked. These levels may additionally be determined at initialization, as above, by using preselected percentages of the input current when the fan is operating normally.

Many other alternative means of setting the minimum current threshold may be visualized and are within the scope of the present invention.

While the preferred embodiments of the present invention have been illustrated in detail, it should be apparent that modifications and adaptations to those embodiments may occur to one skilled in the art without departing from the scope of the present invention as set forth in the following claims.

We claim:

1. A method for detecting a blocked venturi of a DC electric fan comprising the steps of:

monitoring the input current to said DC electric fan;

measuring the minimum current of said input current under normal operating conditions;

setting a minimum current threshold at a value less than said normal operating condition measured current; and detecting a minimum current of said monitored input current equal to or less than said threshold to indicate a blocked venturi.

2. The method for detecting a blocked venturi of a DC electric fan of claim 1 comprising the additional step of:

responding to said detection of a blocked venturi by issuing a command to turn off said fan.

3. The method for detecting a blocked venturi of a DC electric fan of claim 1, wherein said fan cools a device, comprising the additional step of:

responding to said detection of a blocked venturi by issuing a command to operate an alarm or turn off said device.

4. The method for detecting a blocked venturi of a DC electric fan of claim 1, wherein said monitored input current comprises analog signals, and said monitoring step additionally comprises converting said analog signals to digital signals.

5. The method for detecting a blocked venturi of a DC electric fan of claim 4, wherein said setting step comprises storing said measured normal operating condition current value, calculating said minimum current threshold at a predetermined difference from and less than said stored normal current value, and storing said calculated threshold value.

6. The method for detecting a blocked venturi of a DC electric fan of claim 5 comprising the additional step of:

responding to said detection of a blocked venturi by issuing a command to turn off said fan.

7. The method for detecting a blocked venturi of a DC electric fan of claim 5, wherein said fan cools a device, comprising the additional step of:

responding to said detection of a blocked venturi by issuing a command to operate an alarm or turn off said device.

8. The method for detecting a blocked venturi of a DC electric fan of claim 5, wherein said setting step calculated threshold value is set at 3% less than said stored normal current value.

9. The method for detecting a blocked venturi of a DC electric fan of claim 5, wherein said step of detecting said minimum current equal to or less than said threshold additionally comprises calculating the difference between said stored threshold value and said detected value; and determining from said difference whether the input or the output of said fan is blocked.

10. A fan venturi blockage detector for a DC electric fan, comprising:

a current detector for measuring the input current to said DC electric fan; and a processor connected to said current detector 1) to store said measured input current value for the minimum input current to said fan under normal operating conditions, 2) to set a minimum current threshold at a value less than said normal operating condition measured current, 3) to compare subsequent said measured input current values with said minimum current threshold value, and 4) to provide an error signal upon said subsequent measured input current having a value equal to or less than said minimum current threshold value.

11. The fan venturi blockage detector of claim 10, additionally comprising:

a signal connection from said processor to said fan for transmitting said error signal to said fan to turn off said fan.

12. The fan venturi blockage detector of claim 10, wherein said fan cools a device, said detector additionally comprising:

a signal connection from said processor to said device for transmitting said error signal to said device to operate an alarm or turn off said device.

13. The fan venturi blockage detector of claim 10, wherein said current detector comprises an analog measurement circuit and an analog to digital converter.

14. The fan venturi blockage detector of claim 13, wherein said processor sets said minimum current threshold value at a predetermined difference from and less than said stored normal current value.

15. The fan venturi blockage detector of claim 14, wherein said minimum current threshold value predetermined difference from said stored normal current value set by said processor is 3% less than said stored normal current value.

16. The fan venturi blockage detector of claim 15, additionally comprising:

a signal connection from said processor to said fan for transmitting said error signal to said fan to turn off said fan.

17. The fan venturi blockage detector of claim 15, wherein said fan cools a device, said detector additionally comprising:

a signal connection from said processor to said device for transmitting said error signal to said device to operate an alarm or turn off said device.

18. The fan venturi blockage detector of claim 15, wherein said processor additionally responds to said provision of an error signal to calculate the difference between said minimum current and said detected value, and to determine from said difference whether the input or the output of said fan is blocked.

* * * * *